US005129629A

United States Patent [19]

Christensen

[11] Patent Number: 5,129,629

[45] Date of Patent: Jul. 14, 1992

[54] APPARATUS FOR FEEDING MATERIAL INTO A MOLTEN STREAM

[75] Inventor: Henning J. Christensen, Reading, Mich.

[73] Assignee: Hickman, Williams & Company, Livonia, Mich.

[21] Appl. No.: 596,198

[22] Filed: Oct. 11, 1990

[51] Int. Cl.[5] ..... B22D 37/00

[52] U.S. Cl. ..... 266/81; 266/216; 222/594

[58] Field of Search ..... 222/602, 594, 603; 266/81, 216, 78; 164/155, 154

[56] References Cited

U.S. PATENT DOCUMENTS

| | | | |
|---|---|---|---|
| 3,224,051 | 12/1965 | Brown et al. | 266/216 |
| 3,260,591 | 7/1966 | Brown et al. | 266/216 |
| 3,511,490 | 5/1970 | Brown | 266/216 |
| 3,592,363 | 7/1971 | Stout et al. | 222/193 |
| 3,682,131 | 8/1972 | Algeri et al. | 118/2 |
| 3,702,151 | 11/1972 | DeBlok et al. | 164/154 |
| 3,733,014 | 5/1973 | Pflaum | 222/602 |
| 3,818,971 | 6/1974 | Schutz | 164/155 |
| 3,995,681 | 12/1976 | Schmid et al. | 164/154 |
| 4,352,605 | 10/1982 | Godding et al. | 266/81 |
| 4,614,223 | 9/1986 | Wilson | 164/475 |

FOREIGN PATENT DOCUMENTS 0541573 3/1977 U.S.S.R. .

OTHER PUBLICATIONS

Heaslip et al., "Model Study of Fluid Flow and Pressure Distributing During SEN Injection—Potential for Reactive Additions During Continuous Casting," *Transactions of the ISS*, pp. 49-64 (Aug. 1987).

*Primary Examiner*—S. Kastler

*Attorney, Agent, or Firm*—Harness, Dickey & Pierce

[57] ABSTRACT

An apparatus for adding a predetermined amount of inoculant into a molten metal stream having a conveyor means which accurately provides a desired amount of inoculant to a holding chamber mechanism which becomes pressurized and delivers the inoculant under pressure into the molten metal stream. A programmable controller regulates the apparatus to inject accurately measured amounts of inoculant in an automated fashion into the molten metal stream as it fills varying sized molds.

15 Claims, 1 Drawing Sheet

APPARATUS FOR FEEDING MATERIAL INTO A MOLTEN STREAM

BACKGROUND AND SUMMARY OF THE INVENTION

The present invention relates to mold casting and, more particularly, to an apparatus for adding material into a stream of molten metal as it is poured into a mold.

It is known to feed various materials or additives into a stream of molten metal for a variety of purposes. In the steel manufacturing industry, for example, compressed air has been used to inject powdered aluminum into molten steel as it is poured from a ladle into a mold. However, prior known systems tend to be inaccurate and wasteful of the additive material because the amount of material to be added is not accurately measured and finely controlled to correlate to the specific amount of molten metal being cast.

In the manufacture of nodular graphite cast iron or gray iron, it has been common to add an inoculant to the molten metal, in order to cause nucleation of the graphite in the iron, either in the pouring ladle or in the mold itself. Proper nucleation of the graphite in the iron provides uniform microstructures that in turn provide more consistent mechanical properties of the iron casting. See, for example, U.S. Pat. No. 4,352,605 entitled "Means for Adding Materials to a Flowing Stream". Coating the mold with inoculant or adding inoculant in the ladle have been found to be unsatisfactory practices. Coating the mold with inoculant produces uneven nucleation of the graphite in the iron. Addition of inoculant when the molten metal is in the ladle is wasteful as an appreciable amount of the full effect of the added inoculant is not realized due to oxidation of the inoculant before the molten metal reaches the mold. Still another unsatisfactory method consists of placing a selected amount of inoculant in the mold opening to be absorbed up by the molten metal as it enters the mold. However, this latter method also leads to sporadic distribution of the inoculant within the molten material, thereby producing a nonuniform microstructure within the casting.

It has been found that better and more consistent results are produced, with a lesser quantity of inoculant, if the inoculant is added as late as possible to the molten stream but before the molten stream reaches the mold. See, for example, U.S. Pat. No. 4,352,605 entitled "Means for Adding Materials to a Flowing Stream". The apparatus of that patent, however, incorporates expensive optical or heat sensing components which do not provide accurate measuring of the inoculant to achieve optimum utilization of the inoculant. Thus, while it is desirous to have a device which adds inoculant to a molten stream prior to addition to the mold, it is also desirous to have a device which predetermines the amount of inoculant to be added into the molten stream and accurately measures the amount of inoculant to be added into the molten stream. It is further desirable that the measuring and adding of inoculant be automatically conducted in order to make the addition process as efficient and economical as possible.

Accordingly, it is an object of the present invention to provide an apparatus for automatically adding an accurately predetermined amount of inoculant into a molten stream just before the molten stream enters the mold. The addition of an accurate predetermined amount of inoculant achieves uniform castings while in turn reducing the frequency of casting rejects. The present invention also provides an apparatus which is adjustably programmable to add a desired amount of inoculant to the molten metal stream, over the pouring period of the mold, on a mold by mold or pour by pour basis. The present invention further provides for injection of the inoculant into the molten metal stream prior to the entrance into the mold, either adjacent to the molten metal stream or through the ladle pouring stopper rod.

From the subsequent detailed description taken in conjunction with the accompanying drawings and subjoined claims, other objects and advantages of the present invention will become apparent to those skilled in the art.

DETAILED DESCRIPTION OF THE PREFERRED EMBODIMENT

Figure 1:
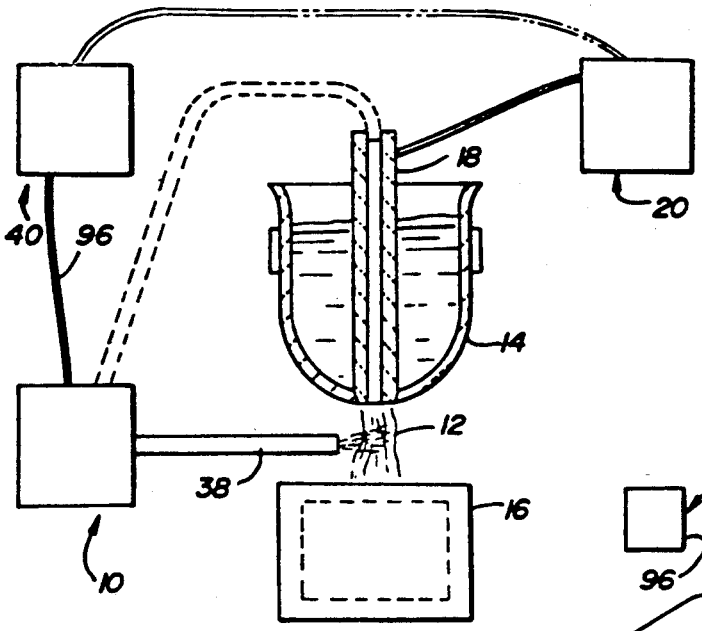
FIG. 1 is a diagrammatic view of the ladle, mold and an inoculant feeding apparatus in accordance with the teachings of the present invention.

Turning to the figures, particularly FIG. 1, an inoculant feeding apparatus in accordance with the present invention is illustrated and designated with the reference numeral 10. The inoculant feeding apparatus 10 is illustrated feeding inoculant into a molten stream 12 that is being poured from a ladle 14 into a mold 16. The ladle 14 generally includes a ladle pouring stopper rod 18 which is controlled by the ladle pouring stopper controller 20. In typical operation, the stopper controller 20 sends a signal to the ladle stopper rod 18 to open, whereupon molten metal material flows from the ladle 14 into the mold 16. As the stopper rod 18 opens, a signal is also sent to the inoculant feeding apparatus 10 which then injects a predetermined amount of inoculant into the molten stream 12 as the stream pours into the mold 16.

The inoculant feeding apparatus 10 generally includes a first hopper 30 to receive and hold inoculant from an inoculant source. The first hopper 30 is associated with a vibratory mechanism 32 which provides or conveys the inoculant from the first hopper 30 to a second receiving hopper means 34. The second receiving hopper means 34 is associated with a holding and receiving mechanism 36 which, in turn, is associated with an inoculant dispensing conduit 38 to provide access for the inoculant to the molten stream 12. The vibratory mechanism 32, second hopper means 34 and holding mechanism 36 are all linked to a controller 40 which controls and monitors the injection of inoculant into the stream 12, as will be explained herein.

The first hopper 30 is generally of the gravity flow type and may include a screen or mesh to prevent large chunks of inoculant from entering the injection system. The first hopper 30 is positioned directly above and very close to one end of the vibratory mechanism 32 such that the inoculant in the hopper 30 is transmitted or gradually metered by gravity flow onto the vibratory mechanism 32 as it is activated. The first hopper 30 is refilled as needed.

The vibratory mechanism 32 is preferably a two speed conventional vibrating conveyor. The vibrating conveyor 32 has an electronic motor 42 coupled with the conveyor to provide vibration to the conveyor. Generally, one of the vibration speeds is faster or more intense than the other to rapidly move the inoculant along the conveyor into the second hopper mechanism 34. When it is desired to very accurately meter the inoculant into the second hopper means 34, the vibratory conveyor will operate at a lower vibrator speed or frequency which provides for slow, accurate feeding of the inoculant. The vibrating conveyor 32 is connected to and controlled by controller 40.

The second hopper means 34 includes a hopper 44, a weighing mechanism 46 and a valve mechanism 48. The hopper 44 receives the inoculant from the vibrating conveyor. Connected to the hopper 44 is the weighing mechanism 46 which includes a sensor for accurately measuring the quantity of inoculant within the hopper 44. The weighing mechanism 46 is electrically connected to the controller mechanism 40 so that when a predetermined amount of inoculant to be injected into a molten stream for a particular mold is sensed by the sensor, a signal is transmitted to controller 40 which, in turn, sends a signal to the vibratory conveyor 32 to stop vibrating.

Accordingly, the weighing mechanism 46 is coupled with the vibratory conveyor 32, via controller 40, to control the amount of inoculant entering into the hopper 44. For example, as inoculant begins to enter into the hopper 44, the vibratory conveyor 32 is operating at its first speed so that inoculant rapidly moves into the hopper 44. As the amount of inoculant approaches the desired preset amount, as determined by the weighing mechanism 46, the speed of the vibratory conveyor 32 is decreased to a second speed wherein the inoculant is slowly fed into the hopper 44. Once the predetermined desired amount of inoculant is sensed by the weighing mechanism 46, a signal is sent from the weighing mechanism 46, via controller 40, to stop the vibratory conveyor 32 and to indicate to the controller 40 that the desired quantity of inoculant is present within the hopper 44.

The hopper means 34 also includes a solenoid operated gate valve 48 which opens and closes in response to signals transmitted to it from the controller 40. Once the weighing mechanism 46 has transmitted a signal to the controller 40 indicating that the desired preset amount of inoculant is present in the hopper, the controller 40 transmits a signal to the gate valve solenoid 49 to open the gate valve 48. Opening valve 48 enables the inoculant to pass from the hopper 44 into the holding mechanism 36. After a predetermined amount of time in which all of the inoculant will empty out of the hopper 44 into holding mechanism 36, a signal is sent to the gate valve solenoid 49 to close the gate valve 48.

The holding mechanism 36 includes a funnel-like holding chamber 50 for receiving inoculant from the hopper means 34, and a solenoid 51 operated fill valve 52, which is coupled with the bottom of the holding chamber 50 to enable the inoculant to pass from the holding chamber 50 into a pressure tank 54. The opening and closing of the solenoid operated fill valve 52 is controlled by signals from the controller 40 to the solenoid 51.

The pressure tank 54 is coupled with the fill valve 52 to receive inoculant from the holding chamber 50. Operably connected to the pressure tank 54 is a regulated pressure source which is coupled with the controller 40. The pressure source is regulated by a first incoming regulator 56 and a tank pressure regulator 57. The tank pressure regulator 57 which is attached to a conduit 39 leading to the tank 54 includes a solenoid operated pressure valve 58, check valve 59, a relief valve 61 and a tank pressure switch 63. The pressure valve 58 opens and closes in response to signals transmitted from the controller 40 to enable pressurized fluid such as air to enter into the pressure tank 54.

A feed pinch valve 60 is coupled between an existing part of the pressure tank 54 and the inoculant dispensing conduit 38. The valve 60 is operated by solenoid 71 in response to signals from the controller 40, as will be further described herein.

The valves 52 and 60 are operated on a time delay such that after the ladle stopper rod 18 is closed, the controller 40 sends a signal to the fill valve solenoid to open the fill valve 52 thereby enabling inoculant to be transferred from the holding chamber 50 into the pressure tank 54. Prior to inoculant being transferred into the pressure tank 54, the pressure valve 58 is closed, to prevent any pressurized fluid from entering pressure tank 54 during the fill cycle, and a solenoid 73 opens a pinch valve 65 to enable any pressure within the tank 54 to vent to atmosphere, via valve 65, and therefore be released from tank 54. When the pressure within the tank 54 is reduced to 0.5 psi, the tank pressure switch 63 activates the solenoid 51 to open the fill valve 52, thereby permitting the flow of inoculant into the pressure tank 54. The pinch valve 65 remains open during transfer of the inoculant into the tank 54. After a predetermined time delay equated to the amount of time that it takes to empty the inoculant from the hopper 50 into the tank 54, pinch valve 65 is closed by solenoid 73.

Next, the controller signals solenoid valve 58 to open to enable pressurized fluid to be transferred via conduit 39 into the pressure tank 54. After appropriate signals have been transmitted from the stopper controller 20 to the controller 40 indicating opening of stopper rod 18, after a predetermined time delay the feed valve 60 is signalled by the controller 40 to open wherein the inoculant is carried along by the pressurized fluid out of the pressure tank 54 through orifice 81, through conduit 38 that is connected to the orifice 81, and into the molten stream 12. The orifice 81 provides a uniform volumetric flow of inoculant and pressurized fluid to flow from the tank 54 into the conduit 38. The downstream end of the conduit 38 delivers the inoculant to the molten stream. The end of conduit 38 is typically positioned in close proximity to the molten stream as shown in FIG. 1. Alternatively the end of conduit 38 may be incorporated as part of the stopper rod assembly shown in phantom to inject the inoculant even more uniformly into the molten material as it flows through the stopper rod 18 and into the mold 16. Prior to the opening of valve 60, solenoid valve 62 is actuated to enable feed fluid to enter into conduit 67, which is coupled downstream with conduit 38, to further enhance the uniform feed of inoculant into the molten stream. Conduit 67 includes a pressure regulator 74, a dial stop regulating valve 75, a pressure switch 76, a pressure gage 78, and a diluter sleeve and holder 77. These elements enable monitoring of the feed fluid flow through the conduit 67 to conduit 38.

Pressure switch 76 is coupled to the controller 40 and provides line pressure information to the controller 40 which is processed to indicate "no flow" and "plugged flow" conditions. If the feed conduit 38 becomes plugged, back pressure is experienced by pressure switch 76. As the back pressure increases beyond a preset limit, the controller 40 shuts down the feeding apparatus 10 until the apparatus is unplugged thereby preventing damage to the apparatus and uninoculated molds. The pressure switch 67 senses a certain amount of back pressure when inoculant as well as feed fluid is entering into the conduit 38. If the back pressure at the pressure switch 76 is at a level which indicates that feed fluid only is passing through the system, e.g. inoculant is not present, an appropriate signal is sent to the controller 40 which is to indicate a "no flow" condition.

During normal operation, after a predetermined period of time which is calculated to enable all of the inoculant to be injected through the conduit 38 and into the molten stream, the controller 40 transmits a signal to the solenoids operating the second valve 60 and valve 62 to close the valves which terminate flow of the inoculant and pressurized fluid into the molten stream. At the same time the controller 40 transmits a signal to close the solenoid valve 58 and to open valve 65 (via solenoid 73) to continue the cycling of the apparatus.

Figure 2:
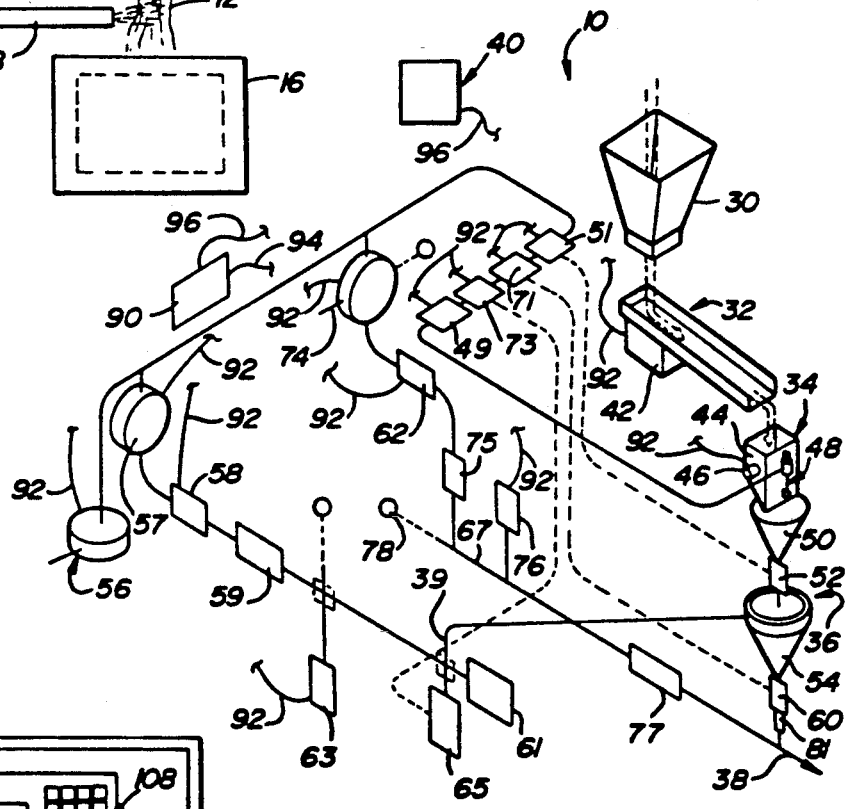
FIG. 2 is a schematic view of an inoculant feeding apparatus in accordance with the present invention.

A junction box 90 is associated with the above elements of the inoculant feeder apparatus 10 as indicated in FIG. 2. The junction box 90 includes a wiring harness 94 which is coupled with the lead lines 92 of the elements. The elements are coupled between the junction box 90 and with the controller 40 via a harness 96. The elements, through lead lines 92 and the harnesses 94 and 96, are electrically connected with a power source (not shown) and with the controller 40.

Figure 3:
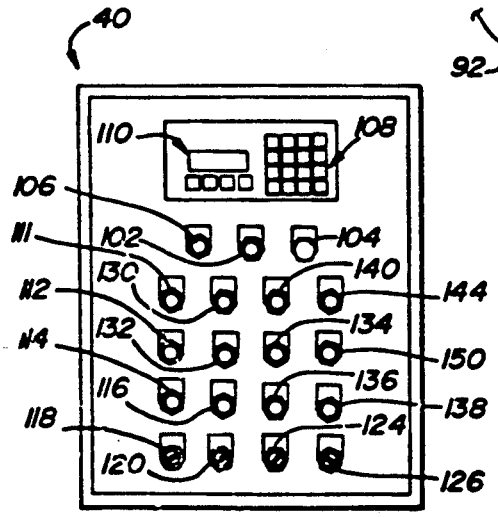
FIG. 3 is a schematic view of a controller panel for an inoculant feeding apparatus in accordance with the present invention.

Turning to FIG. 3, a schematic diagram of the outside panel of the controller 40 is illustrated. The panel includes an "on" switch 102 and an "off" or "kill" switch 104 to turn on and shut down power to the entire apparatus. Upon activation of "on" switch 102, light 106 is illuminated indicating that power is present. The panel of controller 40 includes a keyboard 108 having an LED readout 110. The keyboard 108 enables programming of a desired amount of inoculant to be added into individual molds. As a desired amount of inoculant is entered into the controller 40 via the keyboard 108, the LED readout indicates the specific amount of inoculant that will be added to the individual molds. Depending on the software utilized, the controller 40 may, for example, provide for the programming of different desired amounts of inoculant to be added to each of a series of like molds. (Each mold would be pre-programmed to receive its desired amount of inoculant.) An operator simply enters the proper sequence on the key board 108 for a particular quantity of inoculant to be injected into the metal stream of a particular mold as it is filled. Thus, as the particular mold arrives at the ladle pourer 14, the controller 40 insures that the desired amount of inoculant is injected by the inoculant feeding apparatus into the molten stream 12 as it passes into the mold.

Several switches and indicators are provided on the panel of the controller for supplying various signals to the operator thereby enabling the operator to perform specific functions regarding the feeder apparatus 10 and to control and monitor its operation. Generally, the controller panel includes a vibrator manual feed switch 111 which enables the operator to manually operate the vibratory conveyor 32 when desired. A fill valve switch 112 enables the operator to manually open and close valve 52 to enable inoculant to pass from the holding chamber 50 into the pressure tank 54. Also, a switch 114 enables the operator to manually open and close the hopper gate 48 to enable passage of inoculant from the hopper 44 into holding chamber 50. The controller further includes a switch 116 which enables the operator to manually open and close feed valve 60 which enables inoculant to pass from the pressure chamber 54 into the molten stream. A three-position cycle switch 118 provides for an automatic inoculant feeding cycle, a manual cycle and a duplication of the last cycle. The switch 118 may be set by the operator in any of three positions to achieve the desired function. In the manual position, for example, the switch 118 enables the previously described manual switches to be utilized. In the automatic position, the controller 40 overrides the manual switches, enabling the apparatus to provide a continuous feeding function as described above.

The controller 40 includes an adjustment switch 120 to enable the operator to vary the speed of the vibratory conveyor 32. The switch 120 provides for altering of the speed of the conveyor from a fast to a slow speed. A switch 124 enables the operator to manually vent the pressure from the tank 54 to atmosphere via solenoid 73 and pinch valve 65. The switch 124 may be moved between a pressure position, in which valve 58 operates to pressurize the tank 54, to a vent position in which valve 58 is closed and pressurized fluid in tank 54 is vented through valve 65 to the atmosphere as describe above.

Switch 126 is an injector air switch which enables the operator to manually open and close solenoid valve 62 to provide injector air via conduit 67, into conduit 38. In its "off" position switch 126 does not enable air to be manually passed through the injector. In its "on" position, the switch 126 may be manually actuated to enable fluid to pass through the conduit 38. When switch 126 is either in its "air-on" or auto-feed position, the pressurized fluid continuously cycles to pass fluid through the conduit 38.

The controller 40 also includes several visual or audible indicators to enable the operator to monitor the system as it is operating. For example, in the preferred embodiment shown, the controller 40 includes a first indicator 130 which lights when the predetermined amount of inoculant is in hopper 44 to indicate that the hopper means 34 is at its preset programmed quantity. A second indicator 132 lights to indicate that the fill valve 52 is in an open position to enable inoculant to pass from the holding chamber 50 into the pressurized tank 54. A third indicator 134 lights to indicate to the operator that the apparatus 10 is in a zero pressure condition, i.e. that the vent valve 65 is open. When the apparatus 10 is at zero pressure, as described above, the inoculant is permitted to pass from the holding chamber 50 into the pressurized tank 54. A fourth indicator 136 lights to indicate when the valve 58 is open thereby permitting pressurized fluid to enter into the pressurized tank 54. A fifth indicator 138 is provided and will illuminate when the solenoid valve 62 is open to allow flow of pressurized fluid through the conduit 67 and out conduit 38. A sixth indicator 140 will light to indicate the presence of a "no flow" situation in the pressure tank 54, in which case an audible alarm will also sound to alert the operator of the "no flow" condition.

A seventh indicator 144 is provided as part of the present invention and will illuminate if the conduit 38 becomes plugged. In this situation, an audible alarm may also sound as the controller 40 shuts down the system to indicate to the operator that the conduit 38 is in a plugged condition. The controller 40 further includes a reset switch 150 which enables resetting of the indicator lights, switches and alarms upon remedying of any of the malfunctions noted above. Once the controller 40 is reset, the lights, alarms and switches are ready to function again.

The above-noted switches and indicator lights are electrically connected with valve solenoids, pressure regulators, pressure switches and sensors or the like by conventional means to provide the desired signals between the feeding apparatus and the programmable logic controller 40. The controller 40 utilizes the signals to activate indicator lights or audible alarms as desired, or to provide manual or automatic function of the particular apparatus components. The controller 40 includes a wiring harness 96 for coupling the controller to the junction box 90 and thereby providing a means of interfacing with the individual apparatus components thus enabling the controlling and monitoring functions of the controller 40 to be carried out.

While the above detailed description describes the preferred embodiment of the present invention, it will be understood that the present invention is susceptible to modification, variation and alteration without deviation from the scope and fair meaning of the subjoined claims.

What is claimed is:

1. An apparatus for feeding inoculant into a molten metal stream comprising:

first holding means for maintaining inoculant to be injected into the molten stream;

means for providing a predetermined amount of inoculant to be injected into said molten metal stream, said providing means associated with said first holding means for receiving inoculant from said first holding means;

second holding means for receiving said desired amount of inoculant from said providing means;

means for selectively pressuring said second holding means;

means for providing access from said second holding means to said molten stream to enable said predetermined amount of said inoculant within said second holding means to pass to said molten stream; and means for controlling said apparatus such that said predetermined amount of inoculant is accurately measured and passed into said second holding means while said access means is closed, said second holding means is pressurized by fluid flow into said second holding means, said access means is opened to enable pressurized fluid containing said predetermined amount of said inoculant to pass through said access means into said molten stream, whereby said control means is coupled with a stopper control means which generates a signal to a stopper rod of a pouring ladle to open and close said stopper rod, which holds said molten metal which upon opening of said stopper rod enables flow of said molten metal in a stream into a mold and which upon closing of said stopper rod terminates the flow of said molten metal stream, said control means regulating the operation of said apparatus in response to signals of continuous cycling of said ladle stopper rod.

2. An apparatus according to claim 1 wherein said providing means includes a vibratory conveyor for receiving said inoculant from said first holding means and conveying said inoculant to a weighing hopper for measuring the amount of said inoculant received from said vibratory conveyor and passing said inoculant to said second holding means.

3. An apparatus according to claim 2 wherein said vibratory conveyor conveys said inoculant from said first holding means to said weighing hopper until said predetermined amount of inoculant is present in said weighing hopper, whereupon said vibratory conveyor stops conveying said inoculant into said weighing hopper.

4. An apparatus according to claim 1 wherein said second holding means includes valve means for regulating the passage of said inoculant and pressurized fluid into said second holding means and out from said second holding means through said access into said molten metal stream.

5. An apparatus according to claim 1 wherein said controller means is programmable for automatically injecting a predetermined desired amount of inoculant into said molten metal stream.

6. An apparatus according to claim 6 wherein said controller means includes an audible or visible means for indicating a malfunction of said apparatus.

7. An apparatus for feeding inoculant into a molten metal stream being poured from a ladle comprising:

a first hopper for receiving inoculant from an inoculant source;

a vibratory conveyor associated with said first hopper for receiving said inoculant from said first hopper, said vibratory conveyor associated with a control means;

a second hopper associated with said vibratory conveyor for receiving said inoculant from said vibratory conveyor, said second hopper including means for weighing a predetermined amount of said inoculant to be injected into said molten metal stream, said weighing means associated with said control means for controlling the amount of said inoculant that is received from said vibratory conveyor;

a holding chamber associated with said second hopper for receiving said predetermined amount of said inoculant from said second hopper;

a pressure chamber associated with said holding chamber for receiving said predetermined amount of said inoculant from said holding chamber, said pressure chamber having means for becoming pressurized and depressurized with fluid;

conduit associated with said pressure chamber and with said molten stream for receiving said predetermined amount of said inoculant under pressure from said pressure chamber and enabling said pressurized inoculant to exit into said molten stream and;

valve means for controlling the flow of said predetermined amount of said inoculant from said second hopper to said holding chamber, from said holding chamber to said pressure chamber, and for controlling the flow of said predetermined amount of said inoculant and said pressurized fluid from said pressure chamber into said conduit, said valve means being associated with said control means;

said control means regulating said apparatus whereby said inoculant is fed along said vibratory conveyor from said first hopper to said second hopper, said inoculant is weighed until said predetermined amount is needed, passed from said second hopper to said holding chamber, and to said pressure chamber, pressurized fluid is added to said pressure chamber, said predetermined amount of said inoculant is propelled by said pressurized fluid from said pressure chamber through said conduit and into said molten stream, said control means being coupled with a stopper control means, wherein said stopper control means generates a signal to said control means to indicate opening and closing of a ladle pouring stopper rod such that the inoculant movement through the apparatus is in response to the opening and closing signal from said stopper control means to said ladle pouring stopper rod.

8. The apparatus according to claim 7 wherein said vibratory conveyor has a first and a second speed, in said first speed, said inoculant moves rapidly along said conveyor and in said second speed said inoculant moves slowly along said conveyor thereby aiding in the accurate weighing of said predetermined amount of inoculant.

9. The apparatus according to claim 7 wherein said weighing means receives signals from said control means indicating said predetermined amount of inoculant to be added into said molten metal stream for each cycling of said apparatus.

10. The apparatus according to claim 7 wherein said valve means includes:

a gate associated with said second hopper and said control means for opening and closing said second hopper in response to signals from said control means to enable said predetermined amount of said inoculant to pass into said holding chamber;

a first solenoid operated valve between said holding chamber and pressure chamber and associated with said control means, said first solenoid operated valve opening and closing in response to signals from said control means to enable said chamber into said pressure chamber; and a second solenoid operated valve between said pressure chamber and said conduit and associated with said control means, said second solenoid operated valve opening and closing in response to signals from said control means to enable said predetermined amount of said inoculant to pass under pressure from said pressure chamber into said molten stream via said conduit.

11. The apparatus according to claim 7 wherein said control means is a programmable logic controller.

12. The apparatus according to claim 11 wherein said programmable logic controller includes an alarm means for indicating malfunctions of said apparatus.

13. The apparatus according to claim 11 wherein said programmable logic controller enables a mold that receives said molten metal to receive a predetermined amount of said inoculant for each particular mold.

14. The apparatus according to claim 11 wherein said programmable logic controller is time dependant, starting said pressurized flow of said predetermined amount of said inoculant into said molten metal stream and stopping said flow of after a preset amount of time has elapsed.

15. The apparatus according to claim 14 wherein said programmable logic controller includes a first time delay to delay for a preset period after the signal has been received to open said ladle pouring stopper rod, the starting of said pressurized flow, and a second time delay for a preset period after the signal has been received to close said ladle pouring stopper rod, the stopping of said pressurized flow, whereby said predetermined amount of said inoculant is added to said molten metal stream as said stream enters said mold.

* * * * *

UNITED STATES PATENT AND TRADEMARK OFFICE

CERTIFICATE OF CORRECTION

PATENT NO. : 5,129,629

DATED : July 14, 1992

INVENTOR(S) : Henning J. Christensen

It is certified that error appears in the above-indentified patent and that said Letters Patent is hereby corrected as shown below:

Column 1, line 20, 21, delete "or gray iron".

Column 6, line 28, "describe" should be --described--.

Column 6, line 37, "air-on" should be --off--.

Column 7, line 25, 26, "deviation" should be --deviating--.

Column 8, line 23, claim 6, "6" should be --5--.

Column 10, line claim 10, After "said" (second occurrence) --predetermined amount of said inoculant to pass from said holding--.

Signed and Sealed this

Seventh Day of September, 1993

Bruce Lehman

*Attest:*

BRUCE LEHMAN

*Attesting Officer*

*Commissioner of Patents and Trademarks*